US005433148A

United States Patent [19]

Barratault et al.

[11] Patent Number: 5,433,148

[45] Date of Patent: Jul. 18, 1995

[54] CASING FOR A TELESCOPED-TYPE MUNITION

[75] Inventors: Bruno Barratault; Michel Baubois, both of Bourges; Roland Boual, Saint Germain du Puy, all of France

[73] Assignee: Giat Industries, Versailles, France

[21] Appl. No.: 325,276

[22] PCT Filed: Mar. 8, 1994

[86] PCT No.: PCT/FR94/00253

§ 371 Date: Oct. 24, 1994

§ 102(e) Date: Oct. 24, 1994

[87] PCT Pub. No.: WO94/20814

PCT Pub. Date: Sep. 15, 1994

[30] Foreign Application Priority Data

Mar. 12, 1993 [FR] France ..... 93-02895

[51] Int. Cl.[6] ..... F42B 5/045

[52] U.S. Cl. ..... 102/434; 102/430; 102/464

[58] Field of Search ..... 102/430, 433, 434, 439, 102/464, 465, 466, 467, 469, 476, 472

[56] References Cited

U.S. PATENT DOCUMENTS

| | | | |
|---|---|---|---|
| 676,000 | 6/1901 | Henneberg | 102/470 |
| 3,842,739 | 10/1974 | Scanlon et al. . | |
| 3,897,729 | 8/1975 | Schirneker . | |
| 4,691,638 | 9/1987 | Meyer et al. . | |
| 5,127,331 | 7/1992 | Stoops | 102/467 |

FOREIGN PATENT DOCUMENTS

| | | |
|---|---|---|
| 694881 | 8/1967 | Belgium . |
| 2341834 | 9/1977 | France . |
| 2679991 | 2/1993 | France . |
| 1961307 | 6/1971 | Germany . |

*Primary Examiner*—Harold J. Tudor
*Attorney, Agent, or Firm*—Oliff & Berridge

[57] ABSTRACT

A casing includes a cylindrical envelope made of plastic material having a plug of plastic material at each end fitted with a metal reinforcement. The reinforcement is integral with the front plug and includes a ring that has a peripheral cylindrical part and an external edge that entirely covers a top end of the plug, which projects from the envelope.

10 Claims, 2 Drawing Sheets

CASING FOR A TELESCOPED-TYPE MUNITION

BACKGROUND OF THE INVENTION

The scope of the present invention is that of casings for telescoped-type munitions.

Patent FR2679991 features a telescoped-type munition having a casing composed of plastic material, blocked at each end by a plug, also made of plastic material.

Choosing plastic material for the casing makes it easier to unload after firing. In fact the plastic casing does not present any residual radial deformation.

However, the problem arises of the mechanical resistance of the plugs under firing, the plugs also acting as a seal for the propellent gases.

Patent FR2679991 proposes providing metal reinforcing structure for the part of the plugs situated to the outside of the casing envelope. This reinforcing structure is composed of a ring which may be completed by a base plate.

However such reinforcing structure proves to be insufficient to deal with the pressure build-up of the propellent gases generated during firing. A plastic flow of the constituent material of the plugs can be observed, in that case, between the envelope and the reinforcing structure, this material thereafter forming a small wad likely to make unloading the casing more difficult.

Moreover, regarding the front plug, material constituting the plug has been torn off by the projectile.

SUMMARY OF THE INVENTION

An object of the invention is to provide a casing in plastic material designed for a telescoped munition, a casing wherein the mechanical resistance of the plugs under firing has been improved.

Thus, an object of the invention is to provide a casing for telescoped-type munitions composed of a cylindrical envelope in plastic material blocked at each end by a plug in plastic material fitted with metal reinforcing structure comprising a peripheral cylindrical part and an outer edge or base, reinforcing structure that entirely covers one end of the plug projecting from the envelope, a casing including at least one ring-shaped hollow, fitted in the plug near to one end of the envelope which is in contact with the reinforcing structure, a hollow designed to absorb the deformation of the plug under firing thereby avoiding the formation of a wad.

The reinforcing structure shall be composed of a metal ring for the front plug comprising a peripheral cylindrical part and an outer edge and a metal plate for the rear plug comprising a base and a peripheral cylindrical part.

In entirely covering the top end of the front plug, the ring ensures that this part of the plug, designed to come into contact with the gun, is held in place.

The cylindrical part and the outer edge prevent a ring-shaped wad from forming in the front part of the casing during firing. The ring-shaped hollow absorbs the deformation of the plastic material of the plug thereby preventing a wad from forming between the casing and the reinforcing structure of the plug.

In a similar way, the plate entirely covers the bottom end of the rear plug and ensures that this part of the plug, designed to come into contact with the gun, is held in place.

The cylindrical part and the base thereby prevent a ring-shaped wad from forming at the rear of the casing, the ring-shaped hollow absorbing the deformation of the plastic material of the plug.

According to one particular embodiment of the invention, the ring-shaped hollow is marked out by two ring-shaped surfaces roughly flattened and perpendicular to the axis of the munition, one supported by the reinforcing structure, the other by the plug.

According to a further characteristic the reinforcing structure is made integral with the plug by catching a ring-shaped rim on the ring in a peripheral groove of the plug.

The external diameter of the reinforcing structure is at least equal to that of the nominal diameter of the envelope at the maximum operational temperature of the munition.

According to a further characteristic of the invention, there is at least one internal ring-shaped cavity provided between the front ring and the reinforcing ring in such a way as to absorb the axial and radial deformations of the plug caused by the passage of the projectile during firing.

According to one variant, at least one plug comprises a peripheral ring-shaped groove designed to fit opposite the envelope, and the envelope is deformed so as to slip into the groove of the plug during assembly thereby making the latter integral with the plug.

The deformation can be carried out level with a number of indentations evenly distributed at an angle.

A further object of the invention is a munition of the telescoped-type comprising such a casing in which a projectile, a propelling charge and a primer for the propelling charge have been placed.

BRIEF DESCRIPTION OF THE DRAWINGS

The invention will be better understood after reading the following description of the particular embodiments of the invention made in reference to the drawings, wherein.

DETAILED DESCRIPTION OF PREFERRED EMBODIMENTS

Figure 1:
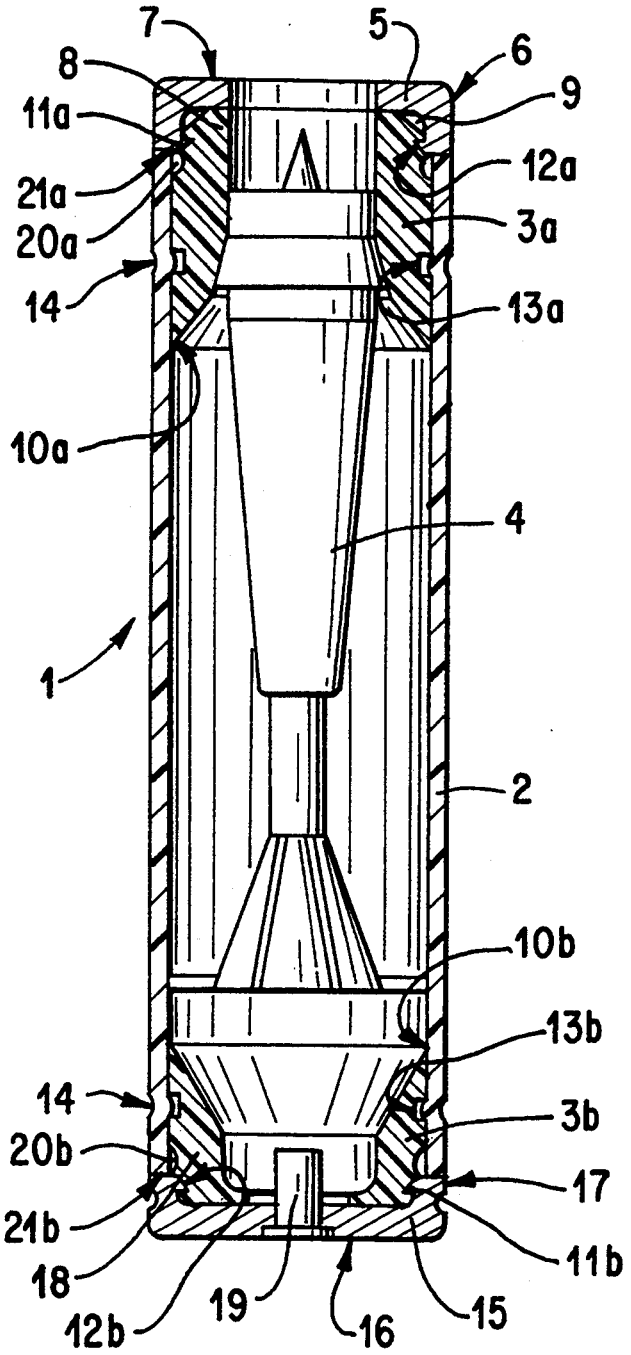
FIG. 1 represents a cross-section of a telescoped munition comprising a casing according to the invention.

Referring to FIG. 1, a casing for a munition 1 of the telescoped-type is composed of a cylindrical envelope 2 made of plastic material, blocked at each end by two plugs 3*a*, 3*b* also made of plastic material.

The casing is designed to contain a projectile 4 as well as a propelling charge (not represented).

The projectile sketched on FIG. 1 is of a subcaliber fin-stabilized type, but other types of projectile and notably a projectile to caliber could be installed in such a casing.

Patents FR2647890 and FR2647891 describe different types of telescoped munitions as well as the means to enable the munitions to be positioned with respect to the casing.

The front plug 3*a* is fitted with a metal reinforcing means 5 comprising a ring wherein the external diameter is at least equal to that of the nominal diameter of the envelope 2 at the maximum operational temperature of the munition.

The ring 5 is composed of a peripheral cylindrical part 6 and an outer edge 7 and it covers a top end 8 of the front plug which projects from the envelope 2.

In entirely covering the top end of the front plug, the ring 5 ensures that this part of the plug, designed to come into contact with the gun, is held in place. The cylindrical part 6 and the outer edge 7 prevent a ring-shaped wad from forming in the front part of the casing during firing.

The internal diameter of the ring 5 is less than or equal to the internal diameter of the front plug 3*a*, providing that it is large enough to enable the projectile 4 to pass.

The ring 5 thereby constitutes a stop surface which enables the front part of the plug 3*a* to be held in place during the passage of the projectile 4.

Furthermore the ring 5 prevents the constitutive material of the front plug 3*a* from being torn off during the firing of the projectile, thereby enabling the front plug 3*a* to fulfil its guiding function as the projectile is ejected from the casing.

Such a provision helps to improve the reproducibility of firing performances.

A ring-shaped hollow 20*a* is provided on the plug 3*a* opposite an end 21*a* of the envelope 2 which comes into contact with the reinforcing ring 5.

This ring-shaped hollow absorbs the deformation of the front plug 3*a* after firing.

The formation of a wad upon firing of the constitutive material of the plug between the end of the envelope 21*a* and the reinforcing ring 5 is thereby prevented.

A ring-shaped cavity 9 is provided between the front plug 3*a* and the reinforcing ring 5.

This cavity absorbs the axial and radial deformation of the plug 3*a* caused by the passage of the projectile, thereby preventing the constitutive material of the front plug 3*a* from being torn off during the firing of the projectile and enabling the front plug 3*a* to fulfil its guiding function as the projectile is ejected from the casing.

The size of the ring-shaped hollow and cavity will be calculated according to the values of the operational pressures and the deformation characteristics of the constitutive material of the plug.

A rear part of the plug 3*a* has a sealing lip 10*a* which is slightly over-calibrated with respect to the envelope 2. Such a lip is described by patent FR2679991.

The plug is made integral with the reinforcing ring 5 by catching a ring-shaped rim 11*a* on the ring 5 in a peripheral groove 12*a* of the plug.

The reinforcing ring is mounted by means of a press. The ring-shaped rim 11*a* is applied against the plug 3*a* which undergoes an elastic deformation of its constitutive material to enable the rim to be squeezed into place in the groove 12*a*.

The plug 3*a* also comprises a ring-shaped groove 13*a* which is placed opposite the internal surface of the envelope 2.

When the munition is being assembled, after the projectile has been inserted into the casing, the front plug is made integral with the envelope 2 by regularly deforming the latter in order to squeeze it into the ring-shaped groove 13.

Figure 2:
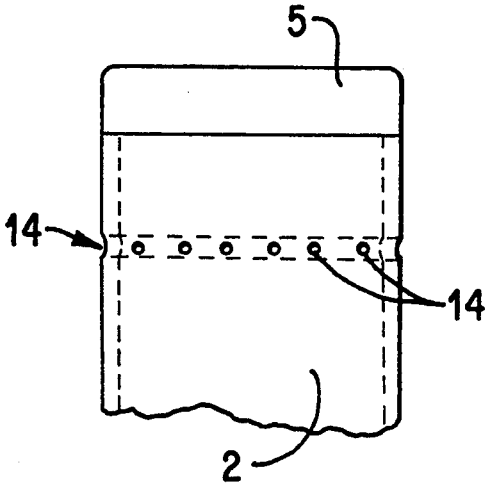
FIG. 2 is an external view of the front part of the casing according to the invention.

The regular indentations 14 are roughly circular, and are produced by means of cold deformation using a cylindrical tool, and the indentations 14 are evenly distributed at an angle around the envelope 2 as is shown in FIG. 2.

During firing these regular indentations 14 do not prevent the plugs 3*a* and 3*b* from shifting with respect to the envelope 2 and pressing on the gun as is described in patent FR2679991.

The rear plug 3*b* of the casing is fitted with a metal reinforcing means which is a plate 15 having a base 16 and a cylindrical part 17.

The external diameter of the cylindrical part 17 is at least equal to the nominal diameter of the envelope 2 at the maximum operational temperature of the munition.

The casing is thus fitted with a cylindrical metal part (6 and 17) at each end.

The diameter of the cylindrical parts is at least equal to the nominal diameter of the envelope 2 at the maximum operational temperature of the munition. Therefore they have a diameter which is always greater than or equal to that of the envelope whatever the operational temperature.

Such a provision enables the casing to be correctly centered in the gun chamber whatever the temperature of the casing and in particular when the temperature is very low and the envelope 2 made of plastic material has a minimal diameter.

The base 16 and the cylindrical part 17 cover a rear end 18 of the plug 3*b* which projects from the envelope.

The plate 15 is fitted with a boring designed to house a primer 19 of the type described by patent FR2679994.

By entirely covering the end 18 of the rear plug 3*b*, the plate 15 ensures that this part of the plug, designed to come into contact with the gun, is held in place.

The plate prevents a ring-shaped wad from forming in the rear part of the casing during firing.

A ring-shaped hollow 20*b* is provided on the rear plug 3*b* opposite one end 21*b* of the envelope 2 which comes into contact with the reinforcing plate 15.

This ring-shaped hollow enables the deformation of the rear plug 3*b* to be absorbed.

The formation of a wad during firing from the constitutive material of the rear plug 3*b* between the end 21*b* of the envelope 2 and the reinforcing plate 15 is thereby prevented.

The size of the ring-shaped hollow will be calculated according to the values of the operational pressures and the deformation characteristics of the constitutive material of the plug.

The plug 3*b* also comprises a sealing lip 10*b* which is slightly over-calibrated with respect to the envelope 2 and a ring-shaped groove 13*b* which is placed opposite the internal surface of the envelope 22.

The plug 3*b* is made integral with the plate 15 by catching a ring-shaped rim 11*b* fitted to the plate 15 in a peripheral groove 12*b* provided in the plug.

The plate is mounted by means of a press in the same way as described hereabove with reference to the front plug 3*a*.

Figure 3:
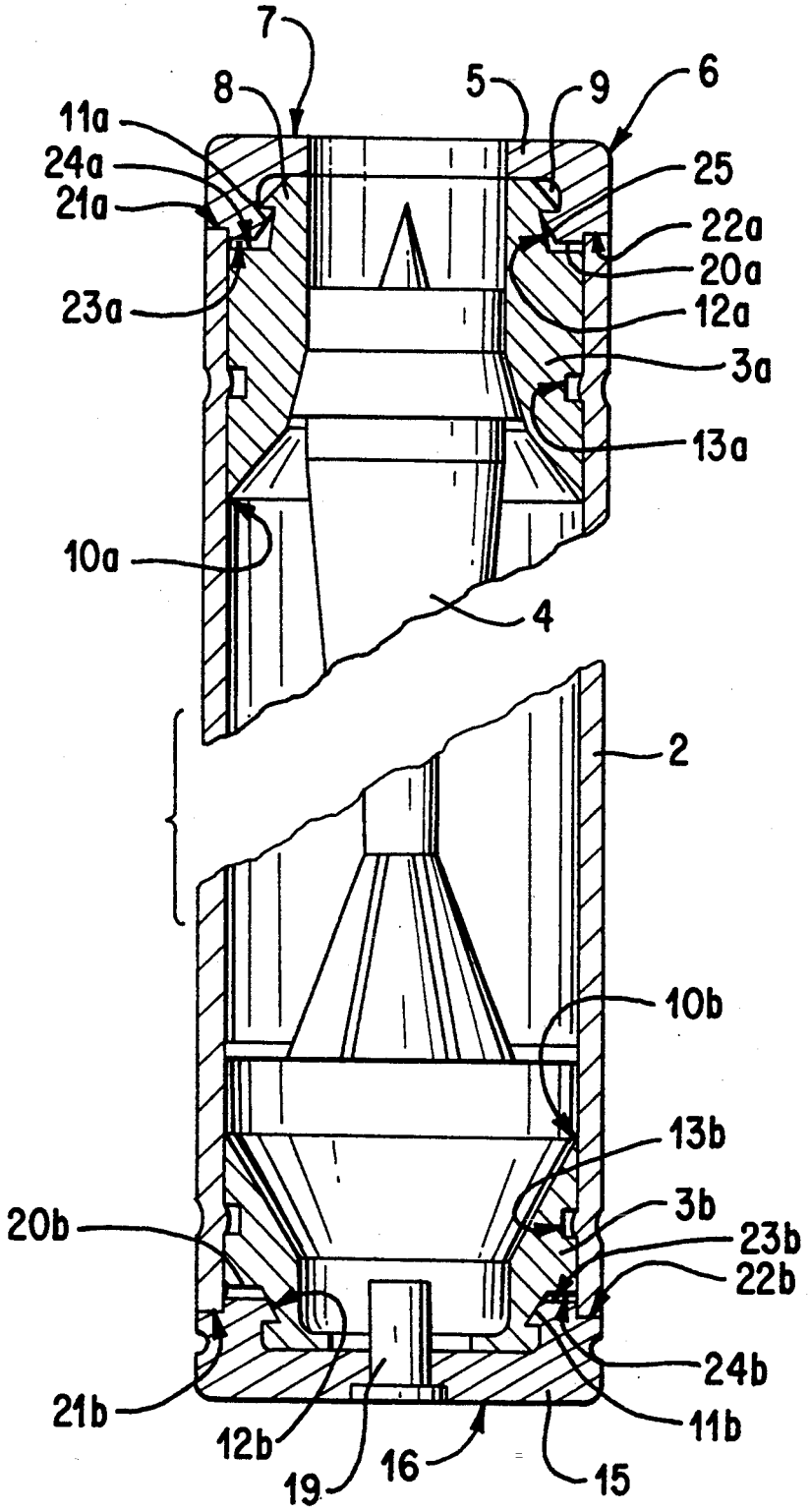
FIG. 3 represents a cross-section on a larger scale of the ends of a munition according to a variant of the invention.

In the variant represented in FIG. 3, the front plug 3*a* is once again fitted with a metal reinforcing means composed of a ring 5 comprising a peripheral cylindrical part 6 and an external edge 7 and covering a top end 8 of the plug which projects from the envelope 2.

The end 21*a* of the envelope 2 abuts against a flange 22*a* fitted on the ring 5.

The ring-shaped hollow 20*a* is provided on the plug 3*a* and is situated roughly opposite the end 21*a* of the envelope 2.

This hollow is marked out by two ring-shaped surfaces 23*a*, 24*a* roughly flattened and perpendicular to the axis of the munition, one (23*a*) supported by the reinforcing means 5 and the other (24*a*) by the plug 3*a*.

Such a provision enables the production of the ring-shaped hollow to be simplified by avoiding further machining. In fact the ring-shaped hollow is merely defined by suitable choice of the respective lengths of the ring 5 and the plug 3*a*.

This provision also enables the material deformation of the plug to be distributed over a greater surface area following an axial direction.

The length of the flange 22*a* provided on the ring will be chosen in such a way that, during firing and after the plugs have shifted due to the gas pressure build-up, the casing is still slightly engaged on the reinforcing ring.

As in previous embodiments, a ring-shaped cavity 9 is provided between the front plug 3*a* and the reinforcing ring 5.

The plug 3*a* is made integral with the reinforcing ring 5 by means of catching a ring-shaped rim 11*a* on the ring 5 onto a peripheral groove 12*a* on the plug.

The relative tapering of the ring-shaped rim 11*a* and of the peripheral groove 12*a* is slightly different herein, thus providing a cone-shaped clearance 25 between the ring 5 and the plug 3*a*, a clearance which communicates with the ring-shaped hollow 20*a*. The purpose of this clearance is the same as that of the ring-shaped cavity 9 in enabling the axial and radial deformations of the plug caused by the passage of the projectile during firing to be absorbed.

As in a preceding variant, the rear plug 3*b* is fitted with a metal reinforcing means composed of a plate 15 comprising a base 16 and a peripheral cylindrical part 17.

The end 21*b* of the envelope 2 buts against a flange 22*b* provided on the plate 15.

A ring-shaped hollow 20*b* is provided on the rear plug 3*b* roughly opposite one end 21*b* of the envelope 2 which comes into contact with the reinforcing plate 15.

This hollow is also marked out by two ring-shaped surfaces 23*b*, 24*b* roughly flattened and perpendicular to the axis of the munition, one (23*b*) being supported by the reinforcing plate 15 and the other (24*b*) being supported by the plug 3*b*.

The plug 3*b* is made integral with the plate 15 by means of catching a ring-shaped rim 11*b* provided on the plate 15 onto a peripheral groove 12*b* provided on the plug. No cone-shaped clearance is provided between the rim and the groove.

Other variants are possible within the scope of the invention.

A casing may therefore be defined wherein there is no ring-shaped cavity at the front plug.

The decision as to the configuration to be adopted depends on the operational pressure values of these casings.

We claim:

1. A telescoped-type munition comprising a casing including a cylindrical envelope made of plastic material, said cylindrical envelope having a plug at each end thereof made of a plastic material, metal reinforcing means for reinforcing each said plug, each of said metal reinforcing means comprising a peripheral cylindrical part and a part selected from the group consisting of an external edge and a base, each said reinforcing means entirely covering one end of each of the plugs that projects from the envelope, and at least one ring-shaped hollow provided on each said plug adjacent one end of the envelope, wherein each said at least one ring-shaped hollow is capable of absorbing deformation of the plug during firing to thereby prevent a wad from forming.

2. The munition according to claim 1, wherein each said at least one ring-shaped hollow is marked out by two ring-shaped surfaces roughly flattened and perpendicular to an axis of the munition, one surface being supported by one of the reinforcing means and the other surface by one of the plugs.

3. The munition according to claim 1, wherein each of the reinforcing means includes a ring-shaped rim engageable with a peripheral groove of each of the plugs.

4. The munition according to claim 1, wherein an external diameter of the reinforcing means is at least equal to a nominal diameter of the envelope at a maximum operational temperature of the casing.

5. The munition according to claim 1, further comprising at least one internal ring-shaped cavity provided between a front one of said plugs and a front one of said reinforcing means thereby enabling absorption of axial and radial deformations of the front plug caused by passage of a projectile during firing.

6. The munition according to claim 1, wherein at least one of said plugs comprises a peripheral ring-shaped groove opposite the envelope, the envelope being deformable into the ring-shaped groove to make the at least one plug integral with the envelope.

7. The munition according to claim 6, wherein the envelope includes indentation points that are evenly distributed on said envelope, said indication points being aligned with said ring-shaped groove.

8. The munition according to claim 1, further comprising a projectile, a propelling charge and a primer for the propelling charge disposed between said plugs within said casing.

9. A casing for a telescoped-type munition, comprising:

a plastic cylindrical envelope;

a plastic plug located at each end of the cylindrical envelope, each said plug including at least one ring-shaped hollow provided adjacent a respective end of the envelope; and a metal reinforcement enclosing the portion of each of said plugs which protrudes from the cylindrical element and communicating with the at least one hollow, each said metal reinforcement having a peripheral cylindrical part and a part selected from the group consisting of a base end and an external edge.

10. The casing according to claim 9, wherein the peripheral cylindrical part of the metal reinforcement engages said at least one ring-shaped hollow.

* * * * *